US005114172A

United States Patent [19]

Rousset et al.

[11] Patent Number: 5,114,172

[45] Date of Patent: May 19, 1992

[54] INTEGRAL BINDING

[75] Inventors: Didier Rousset, Aix les Bains; Gerard Graillat, Annecy, both of France

[73] Assignee: Salomon S.A., Chavanod, France

[21] Appl. No.: 461,593

[22] Filed: Jan. 5, 1990

[30] Foreign Application Priority Data

Jan. 5, 1989 [FR] France ..... 89 00291

[51] Int. Cl.[5] ..... A63C 9/00

[52] U.S. Cl. ..... 280/633; 280/615

[58] Field of Search ..... 280/633, 614, 615, 626, 280/631, 634, 607

[56] References Cited

U.S. PATENT DOCUMENTS 3,977,688 8/1976 Imagawa ..... 280/607

4,890,855 1/1990 Graillat ..... 280/615

FOREIGN PATENT DOCUMENTS 3632815 5/1987 Fed. Rep. of Germany ..... 280/615

*Primary Examiner*—Andres Kashnikow

*Assistant Examiner*—Richard Camby

*Attorney, Agent, or Firm*—Pollock, Vande Sande & Priddy

[57] ABSTRACT

The process consists in embedding two longitudinal ends (23, 24) of an assembly component (21) making up the binding mechanism into stationary parts (16) or parts unitary with the ski (27*a*). According to one embodiment, the locking system of the ski boot is composed of a locking piece (2) which slides longitudinally, and the assembly component is constituted by this movable locking piece (21). The device also comprises a toggle joint system which draws the locking piece (21) into the boot-locking position, and one of the fulcrum members (27*a*) of the toggle joint system is anchored on the ski so as to produce the vertically-oriented recessed housing of one end (24) of the assembly component (21).

22 Claims, 4 Drawing Sheets

INTEGRAL BINDING

FIELD OF THE INVENTION

The present invention relates to a process for the rapid mounting of a ski boot binding mechanism to a ski, and in particular a binding mechanism for a cross-country ski, as well as a ski and binding mechanism adapted for the implementation of such process.

BACKGROUND OF THE INVENTION

Ski boot binding mechanisms are traditionally screw-mounted on skis. An assembly of this kind requires several preliminary operations, and in particular the drilling of holes in the ski, the threading of these holes when the skis are made of metal, and the insertion of the screws.

In addition to the problems of loose parts and the risk of loss of the screws, the mounting requires that the operator exhibit some skill and concentration, especially as regards the positioning of the holes, a procedure requiring special tools.

Furthermore, the presence of the holes in the upper surface of the ski leads to many problems, in particular:

the risk of the entry water on the inside of the ski and, therefore, of the rotting or deformation and damaging of the ski under the effect of freezing;

the fragility imparted to the ski because of the discontinuity of the upper surface prepared in this way.

This latter problem makes itself felt especially with respect to cross-country skis used for racing, for which mechanical resistance is provided basically by the upper layer of the ski and as a result of the narrow width of such a ski, the drilling of binding holes causing a reduction of up to 20% of the transverse surface area.

AT 270 466 proposes bonding the base plate of a binding to the upper surface of the ski using means such as gluing, welding, or duplicate molding.

Bonding means of this kind are, however, difficult to apply by the ordinary retailer, since they require either special tools, for example those used for welding or duplicate molding, or special precautions, for example those required for gluing. DE 23 63 662 proposes, to achieve the rapid mounting/de-mounting of the binding, the screw-mounting of a base plate on the upper surface of the ski, and the assembly of this base plate with the rest of the binding by means of an auxiliary plate capable of being slid and then screwed onto the base-plate.

A binding of this kind does not solve the problem of mounting a binding without drilling holes in the upper surface of the ski, and requires, furthermore, an additional part for fastening the baseplate to the binding itself. This binding does not, moreover, remedy the problem of loose parts, since screws are required at least for attaching the base plate to the auxiliary plate.

SUMMARY OF THE INVENTION

It is an object of the present invention to solve these problems and to supply a procedure for mounting a binding mechanism easily and quickly on a ski, even by a novice, without the aid of any auxiliary part and special tools, and which causes no damage to the upper surface of the ski.

A further object of the invention is to provide a mounting procedure which does not require the use of screws or other loose parts.

This object is achieved using the mounting procedure according to the invention, because of the fact that it consists of recess fitting two opposing longitudinal ends of an assembly component of the binding mechanism in parts which are stationary or form one piece with the ski.

Mounting by the recessed housing of parts may be carried out in an especially simple and rapid manner and does not require the use of any tools or special loose part.

One specific embodiment of this process consists of fitting a first longitudinal end of the assembly component into an associated housing provided for this purpose on the upper surface of the ski, and of housing the second longitudinal end of this assembly component by folding it back on itself and anchoring another element on the ski in this position.

According to a preferred embodiment, in the case of a binding mechanism which incorporates a sliding locking piece, recessed housing is provided at both ends of this locking piece, which thereby constitutes the anchoring component of the binding, and the recessed fitting occurs, in relation to the ski, vertically and transversely only. In a mounting of this kind, not only does the locking piece perform a dual role, i.e., locking the boot on the binding mechanism and the anchoring of this same mechanism on the ski, but the recessed housing arrangement created on the ski also plays a dual role, i.e., anchoring the binding mechanism on the ski and guiding the locking piece of this mechanism in translational motion.

A mounting process of this kind thus allows a reduction in the number of parts used in the binding mechanism-ski system.

According to another preferred embodiment of the ski designed for the implementation of a mounting process of this kind, each housing/anchoring means is composed of a part connected to or incorporated into the ski at the factory; in this arrangement, the housing/anchoring means can be attached to the ski by gluing, welding, duplicate molding, or other similar process.

A solution of this kind makes it possible not only to create a device for anchoring the binding mechanism which is totally incorporated into the ski, but also to avoid all damage to the upper surface of the ski caused by the subsequent connection of this anchoring device.

BRIEF DESCRIPTION OF THE DRAWINGS

The invention will be better understood upon reading the following description, provided with reference to the attached drawings which illustrate, by way of example, several embodiments of the invention, and in which.

DESCRIPTION OF PREFERRED EMBODIMENTS

Figure 4:
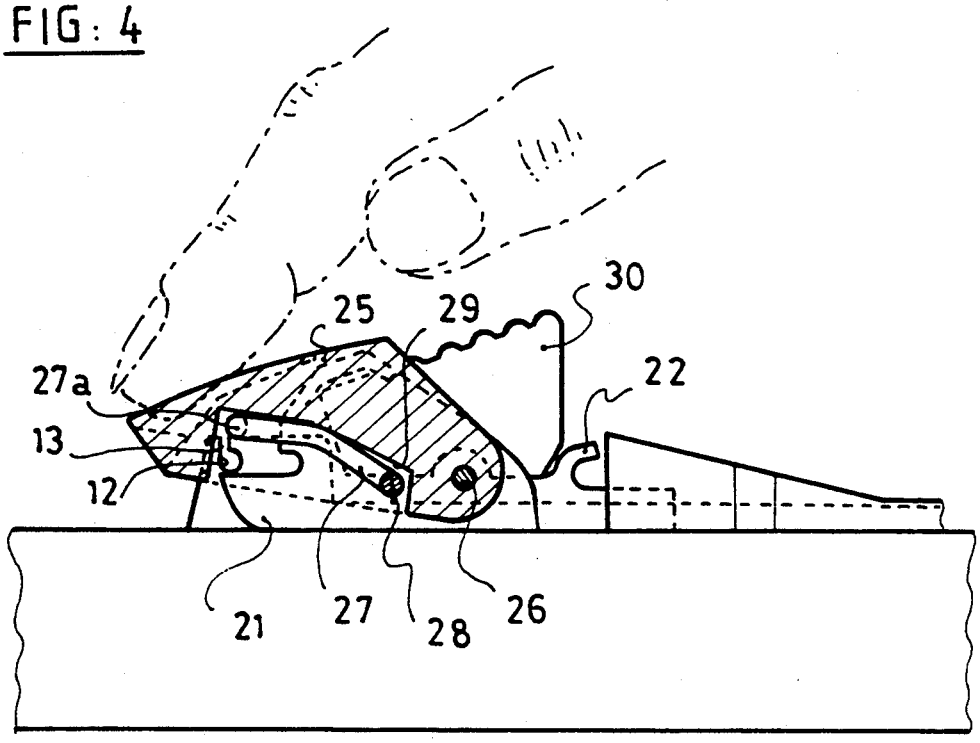
FIG. 4 is a view similar to FIG. 3, during mounting of the binding mechanism on the ski.
Figure 6:
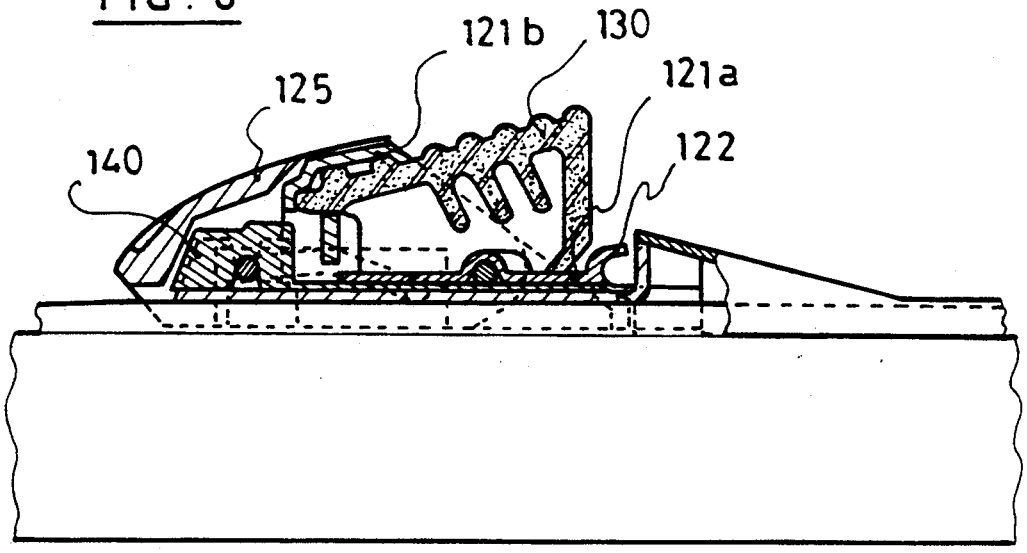
FIG. 6 is a longitudinal cross-section of the mechanism shown in FIG. 5, after mounting.
Figure 5:
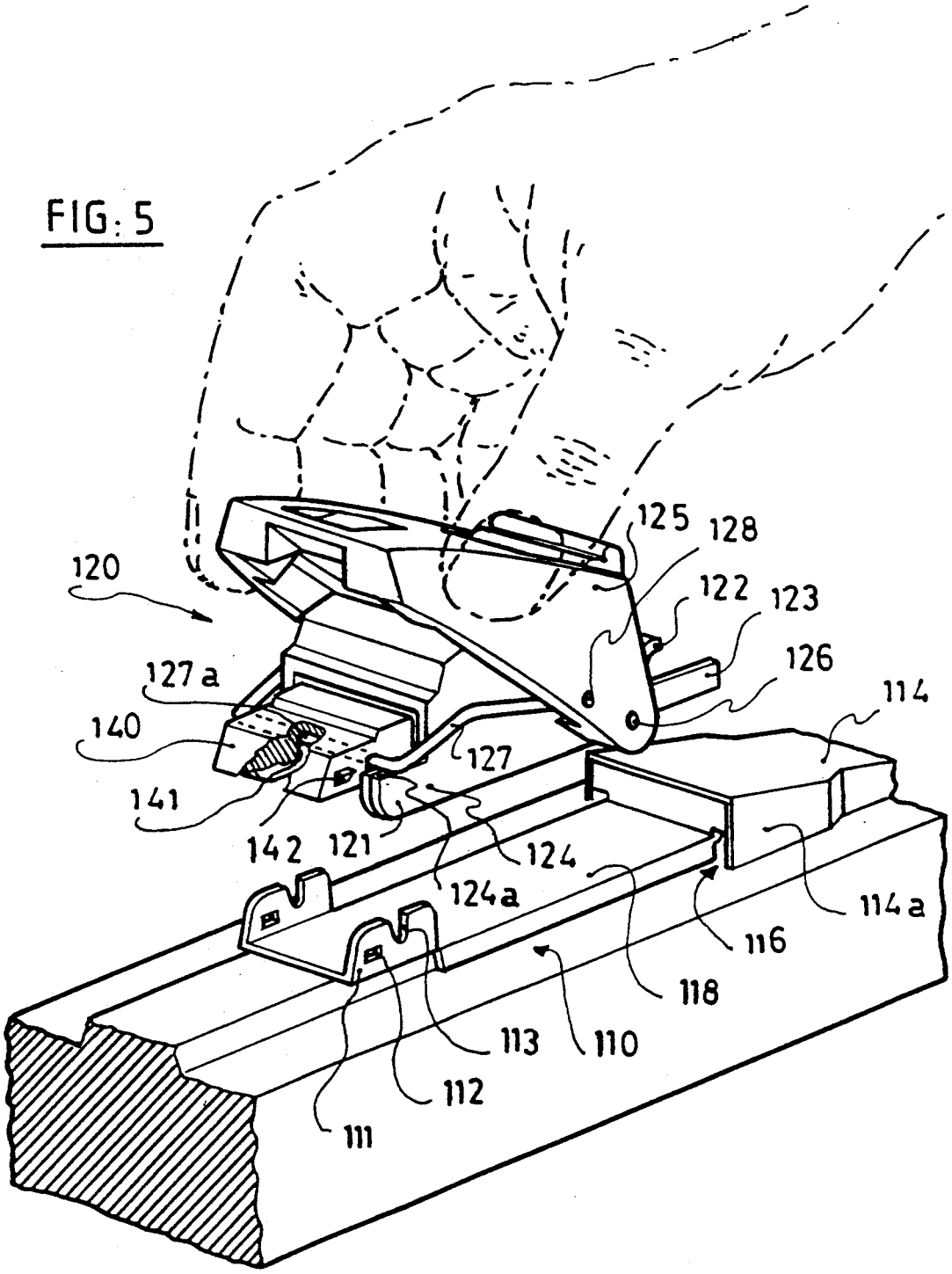
FIG. 5 is a view similar to FIG. 1, of a binding mechanism according to a second embodiment.

The following description of the invention presupposes the use of a hinge-type binding for cross-country skis of the kind incorporating a sliding locking piece, such as that already described in applicant's FR 88.11104, FIGS. 1 to 4 showing the application of the invention to a normal "flat" ski, while FIGS. 5 and 6 illustrate the application of the invention to a ski incorporating a central ridge, called a "contour" ski.

Figure 1:
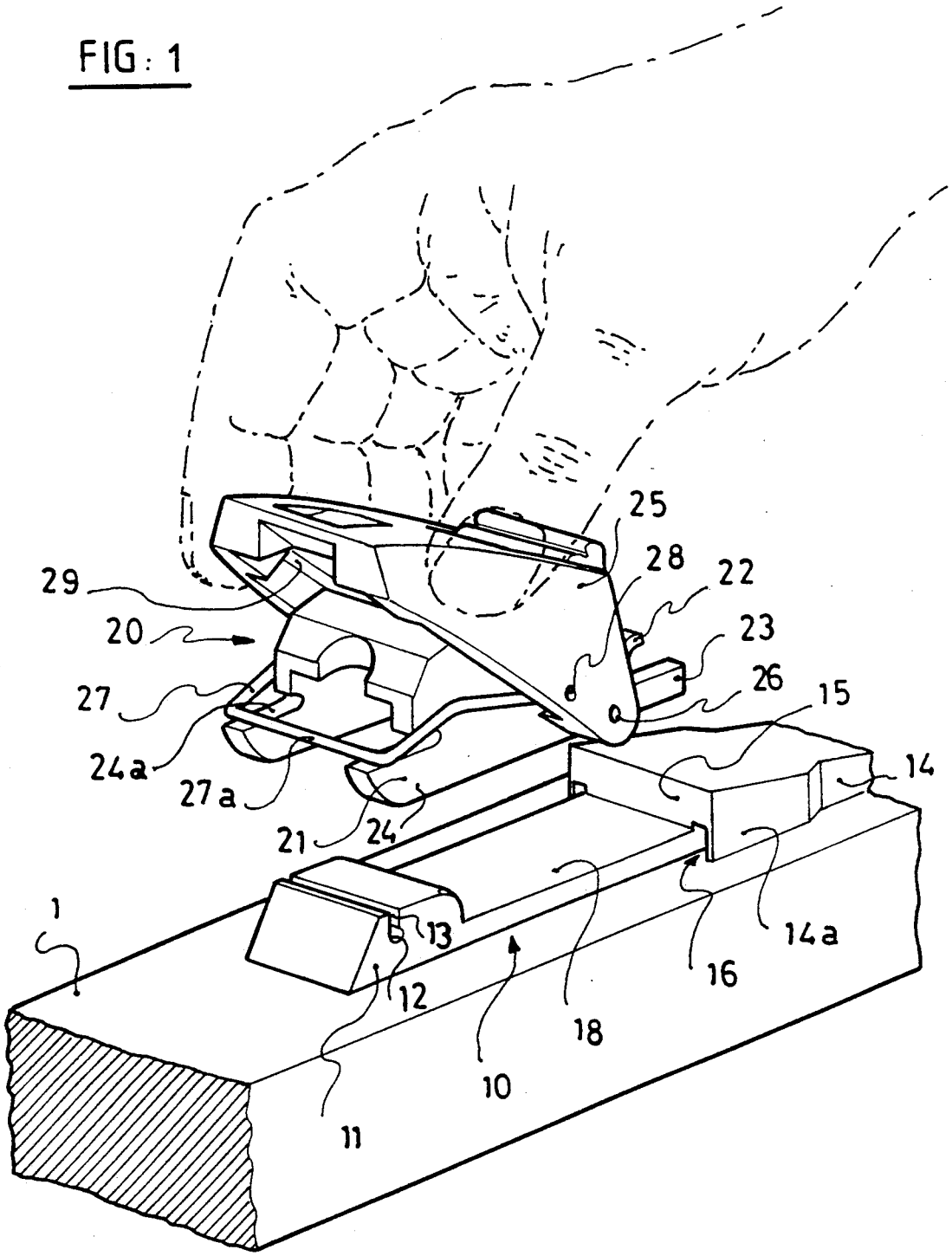
FIG. 1 is a perspective view of the binding mechanism before being mounted on a ski.
Figure 2:
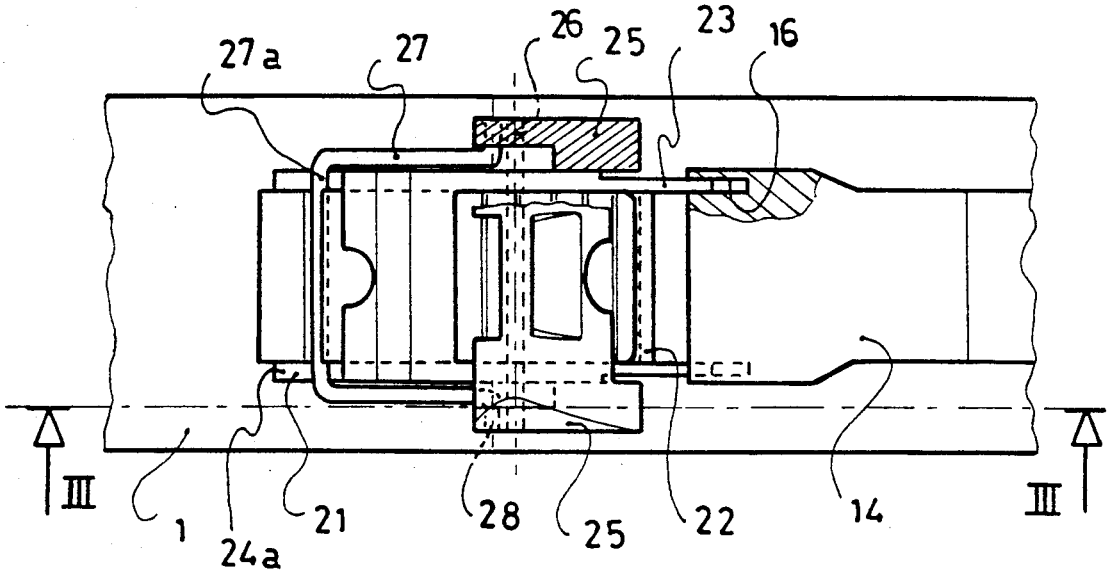
FIG. 2 is a top plan view, partly in cross-section, of the mechanism after mounting.

As is shown in particular in FIG. 1, the binding mechanism used to attaching a boot to a cross-country ski 1 according to the invention is constituted by a first part 10, termed an anchoring piece, which is attached or incorporated into the upper part of the ski, and by a second part 20 designed to be locked onto the first part 10 and making up the actual binding mechanism.

The first part 10 comprises, on its front portion, i.e., on the left side of FIG. 1, a block 11 for anchoring the second part 20.

This anchoring block 11 comprises a transverse groove 12, circular in cross-section, intended to receive the transverse arm 27*a* of a U-shaped wire spring 27 of the second part 20. The groove 12 is connected to the upper surface of the anchoring block 11 by means of a transverse opening 13 of lesser width and which is smaller than the diameter of the wire spring 27. The two edges of the opening 13 are capable of being spread apart elastically to allow the insertion of the wire spring 27 into its groove 12, and then of being restored to their initial position to lock this spring 11 into its groove by a catching effect.

At its rear extremity, the first part 10 constitutes, in a conventional manner, a part or the whole of a guide ridge 14 for the boot.

The front end of this guide ridge 14 forms a vertical support surface 15 for a hinge pin on the boot (not shown) which is to be locked in place by means of the binding mechanism.

Two stationary longitudinal recesses 16 are cut in the guide ridge 14 on the sides of the support surface 15; they are designed to permit the vertical and transverse recessed fitting and the longitudinal guidance of the second part 20 of the binding mechanism.

It will be noted that the guide ridge has, at this spot, an enlarged section 14*a* which allows the incorporation of the recessed-fitting housings 16 and increases the surface 15 supporting the hinge pin of the boot.

The two portions 11 and 14 of the first part 10 are connected by means of a longitudinal rib 18, substantially rectangular in section, which is designed to serve as a slide surface for the sliding locking piece belonging to the second part 20.

The means of fastening part 10 onto the ski is not shown in the drawing; this piece is attached to the ski at the factory by any conventional means which does not damage the surface of the ski, e.g., by gluing or heat sealing. This first part 10 may also be incorporated into the ski during manufacture by duplicate molding.

The second part 20 of the binding mechanism is composed of a locking slide, or sliding locking piece 21, which comprises on its rear section a jaw 22 which cooperates with the support surface 15 of the first part 10 in order to lock the hinge pin of the boot in position.

This slide has, to the rear of its jaw 22, two lateral lugs 23 which form its rear extremity and as designed to fit into the housings 16 in the guide ridge 15, so as to create a first recessed housing and longitudinal guidance arrangement for the slide 21.

At its forward end, slide 21 also has two lateral lugs 24 designed to allow the second recessed fitting of this slide 21, and which comprise slide faces 24*a* on their upper surfaces.

Finally, a stirrup-shaped lever 25 is hinged onto the slide 21 at point 26; a wire spring 27 is in turn hinged onto this lever, at point 28.

As previously noted, this U-shaped wire spring 27 is designed so that its median part snaps into the groove 12 of the anchoring block 11.

As shown more especially in FIG. 4, wire spring 27, lever 25 and slide 21, jointly constitute a toggle-lever locking system, whose axes are constituted by articulation axes 26, 28 and 27*a* and which hold the slide 21 in the locked position.

On the inside of each of its arms, lever 25 has a shoulder 29 whose shape matches approximately that of the wire spring 27. These two shoulders 29 are designed to press the arm 27*a* of the spring wire downward when the second part 20 of the mechanism is positioned in the first part 10.

Finally, an elastic plug 30, designed to draw after it the tip of the boot, is positioned in a conventional manner on the locking slide 21.

Figure 3:
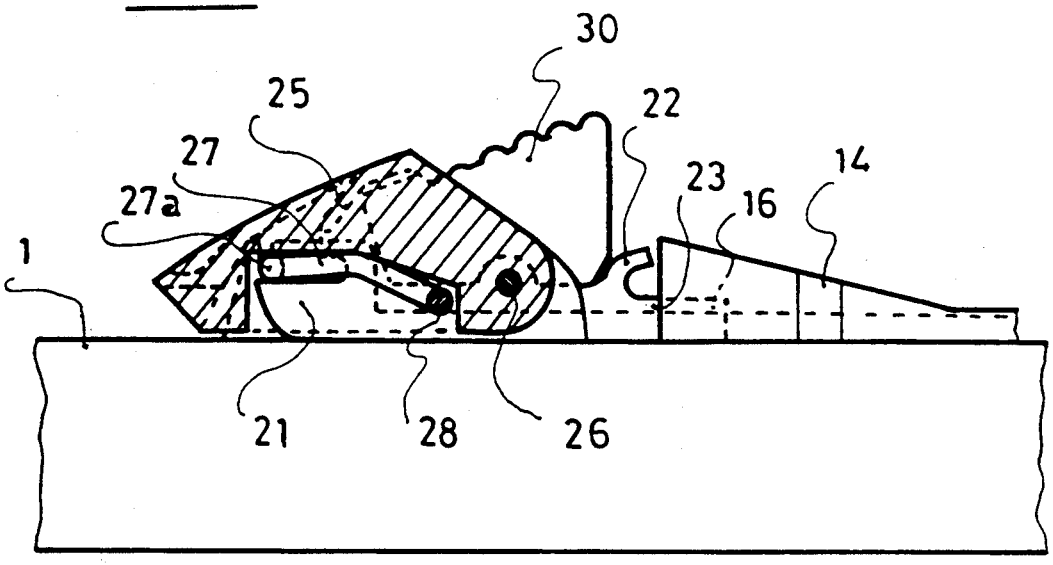
FIG. 3 is cross-section view along line III—III in FIG. 2, showing the unlocking lever in the lowered position.

FIGS. 1, 3, and 4 illustrate the different stages of the mounting process according to the invention.

These steps include, first, the insertion of the two lugs 23 on the first end of the slide 21 into the recessed housings 16 in the first part 10, then the lowering of the other end 24 of the slide 24 against the upper surface of the ski by applying pressure on the locking lever 25. This pressure on the lever 25 causes, through the action of the shoulders 29, the lowering of the arm 27*a* of the wire spring 27 into the opening 13, until it snaps into place in the groove 12.

At this moment, the upper surface 24*a* of the lugs 24 of the slide 21 is in sliding contact against the lower surface of the arm 27*a* of the wire spring, which thus forms a kind of vertically-oriented recessed fitting and a longitudinally-oriented guidance for the forward end of the slide 21, the "recessed housing" in the transverse direction being, at this point, provided by the anchoring block 11 on each side of which the lugs 24 of the locking piece slide.

It will be noted that, in the present description, the word "housing" is used in the broad sense of retention in one or several given directions, in the present instance the vertical and transverse directions.

It is evident that a complete housing in the usual sense is not possible in the case of a locking piece designed to move longitudinally.

It would, on the other hand, be possible, in the case of the anchoring of the binding mechanism using a non-sliding component of this latter, to achieve the total recessed housing of this component at each of its ends. This type of recessed housing might, for example, be produced on a base-plate of the binding mechanism.

It will also be noted that, in the case described, the recessed housing of the two ends of the locking piece is produced, first, using the stationary recessed-fitting housings 16, and second, a movable recessed-fitting system made up of the wire spring 27, thereby making possible a mounting without any deformation of the parts to be embedded.

However, it is entirely conceivable that, especially in the case of the recessed housing of a base-plate, the elasticity of a base-plate of this kind may be used to obtain the fitting of each of its ends into a stationary housing.

It will, therefore, be easily understood that the process according to the invention permits especially simple and rapid mounting of a binding mechanism on a ski, since, as one of its main features, it does not require the use of special tools or instruments such as a screwdriver, nor separate parts such as screws, and that it may, therefore, be performed by anyone, even a person lacking technical skills, in a minimum amount of time.

Furthermore, the extreme simplicity of the system will be noted, a simplicity facilitated by the multiple functions performed by the spring 27, which serves not only as a component of the toggle lever, but also as a component of the vertical recessed housing and as a longitudinally-oriented guide for the movable locking piece.

Although the first part 10 has been described as being formed from a single piece, the various sections of this piece, i.e., the anchoring block 11, the guide ridge 14 and support surface 15, and the slide surface 18, could also be manufactured as separate parts and their assembly effected when they are incorporated into the ski, particularly in the event of duplicate molding. However, the fabrication of the first part 10 as a single piece makes it possible to guarantee the definitive magnitude of the distance between the support surface 15 and the housing 12 of the anchoring block, a magnitude representing one of the fundamental dimensions of the toggle joint locking system.

In the event that parts 11 and 14 are separate elements, slide surface 18 may be omitted; similarly, the two lugs 23 of the locking piece may be replaced by a single lug extending transversely over the entire width of the locking piece 21, and sliding in a corresponding housing of rectangular section, extending over the entire width of the ridge 14.

Finally, it will be understood that an assembly system of this kind is particularly advantageous within the context of an integrated binding, i.e., one which can be delivered with the ski, since the mobility of the second part 20 of the binding makes it possible to preserve the normal bulk of the ski, the first part 10 of the binding creating virtually no excess thickness on the upper surface of the ski; and that various types of binding elements 20 can be connected to the same part 10.

FIGS. 5 and 6 illustrate a binding mechanism according to a second embodiment, in which similar or identical elements are be designated by the same reference numbers (but increased by 100) as in the embodiment previously described; this binding mechanism is illustrated mounted on a ski 101 termed a ridged ski, i.e., one having a longitudinal rib 101*a*.

This mechanism, like the preceding one, is composed of a first part 110 attached to or incorporated into the ski at the factory, and of a second part 120 designed to be locked onto the first part.

The first part 110 comprises, at its rear, a guide ridge 114 delimiting a support surface 115 for one hinge pin of the boot, and, in an enlarged part 114*a*, two stationary housings 116 for the recessed housing of lugs 123 of the second part 120. The first part 110 also comprises on its front portion an anchoring block formed from two vertical walls 111 and connected to the ridge 114 by a strip-shaped part 118.

A vertical opening 113 designed to receive the arm 127*a* of the spring 127 of a toggle joint system fitted on part 120 and a snap-in opening 112 are cut in each of these walls 111. As in the case previously described, the distance from the support face 115 to the opening 113 represents an easential dimension of the toggle joint system, thus making it preferable to manufacture part 110 in a single piece.

The second part 120, like the mechanism previously described, comprises a locking slide 121 equipped with a jaw 122 and designed to slide on element 110.

The slide 121 is moved using a lever 125 to which the wire spring 127 is hinged.

In the embodiment shown, the slide 121 is composed of two parts, 121*a* and 121*b*, the former of which delimits the jaw 122 and the latter, the housing for an elastic plug 130.

As in the example described previously, the recessed fitting of the second element of the binding is designed to be effected on each of the longitudinal ends of the slide 121. This latter has, therefore, at the rear and front ends of its part 121*a*, two lugs, 123 and 124 respectively, designed to be embedded, first, in the recessed housings 116 of the ridge 114, and, second, under the transverse arm 127*a* of the wire spring 127, the upper surface 124*a* of the lugs 124 forming a slide surface.

The fundamental difference between this mechanism and that described earlier lies in the fact that a protective plate 140 is provided on the lower part of the slide 121.

This protective plate 140 is snapped into place on the transverse arm 127*a* of the wire by means of a suitable transverse housing 141, in such a way as to form one piece with the locking slide 121 prior to mounting, and is designed to be attached onto the anchoring block 111 after mounting in order to serve as a slide surface for the locking piece 121.

This plate 140 has, therefore, a transverse section which supplements the transverse section of the slide 121. Lubricant is inserted between this plate 140 and the slide 121.

The protective plate 140 has, on its front section and to permit attachment onto the anchoring block 111, two snap-on projections 142 designed to snap into the openings 112 of this anchoring block 111.

The positioning of the second part 120 in the first element 110 of the mechanism is carried out in the same manner as that described previously, i.e., by housing the lugs 123 in the housings 116 and by snapping the protective piece 140 into the openings 112 of the anchoring block, the transverse arm 127*a* of the spring being engaged in the openings 113 of this anchoring block 111 while producing, vertically, the recessed housing of the lugs 124 of the slide 121 and the longitudinal retention of the plate 140.

In this case, the connection between the two parts 110 and 120 is, in fact, achieved using two functional parts of element 120 which participate in locking the boot in position. These parts are:

the protection plate 140, whose role is to guide and properly lubricate the slide 121, so as to facilitate its sliding motion, as well as to provide protection of the lubricant placed on the lower surface of this slide; and the spring 127, which serves both as a component of the toggle joint system and as a means for retaining the plate 140 in position—before mounting, during transport, and after mounting for holding the plate 140 in a longitudinal orientation—as well as a counter-slide surface for the slide 121.

It will be noted that, in both cases described, the assembly of the two parts of the binding is achieved by housing the two longitudinal ends of the locking slide 21, 121, which constitutes, in fact, the main assembly component of these two parts.

The present invention may be applied to any type of binding mechanism, including binding devices for downhill skis.

In the embodiment illustrated in FIGS. 5 and 6, the connection between the plate 140 and the anchoring block 110 could also be obtained using a pin or similar part, the snap-on connection being, however, preferred because it requires no additional parts.

The second recessed housing arrangement, using the spring 27, 127 in both cases, could also be achieved using another movable component of either of the elements, 10,20; or 110, 120, respectively.

We claim:

1. Ski for mounting a binding mechanism comprising an assembly component and a swingable element, said ski comprising on an upper surface thereof first and second housing means for rear and front longitudinal ends of said assembly component, respectively, said first housing means comprising a recessed stationary housing receiving said rear longitudinal end of said assembly component, and said second housing means comprising means for receiving said swingable element of said binding mechanism adapted to be pulled down onto said front end of said assembly component of said binding mechanism, and to be locked in position in said receiving means on said upper surface of said ski so as to delimit said recessed housing.

2. Ski according to claim 1, wherein said second housing means is made up of an anchoring means (1; 11) designed to lock a housing means (27; 27) unitary with said binding mechanism in place on said ski.

3. Ski according to claim 2, wherein said anchoring means (11, 11) are of a snap-on type (2; 112).

4. Ski according to claim 1, wherein said recessed housing/anchoring means (2, 16; 12, 16) comprises a part (11, 11; 114, 4) unitary with said ski.

5. Ski according to claim 4, wherein said recessed housing/anchoring means (12, 16; 112, 16) form a single part (10, 10) constituting a first element of said binding mechanism.

6. Ski according to claim 5, wherein said assembly component is a sliding locking piece (21), and a connection piece (8) of said housing/anchoring means (16, 12) constitutes a guidance slide surface for said sliding locking piece (2).

7. Ski according to claim 4, wherein said housing/anchoring means (12, 16; 112, 116) is made unitary with said ski by non-invasive means.

8. Ski according to claim 7, wherein said housing/anchoring mans (12, 16; 112, 116) is attached to said ski by welding.

9. Ski according to claim 7, wherein said housing/anchoring mans (12, 16; 112, 116) is attached to said ski by duplicate molding.

10. Binding mechanism adapted to be mounted on a ski as claimed in claim 1, comprising a longitudinal assembly component (12; 121) having ends (23, 24; 123, 124) adapted to be embedded in housings (16, 116) provided on an upper surface of said ski.

11. Binding mechanism according to claim 10, wherein a locking system of said boot is constituted by a longitudinal-sliding locking piece (21; 121) and said assembly component is constituted by said locking piece (21; 121).

12. Binding mechanism according to claim 11, comprising a transverse recessed housing means receiving said fulcrum member.

13. Binding mechanism according to claim 12, wherein said transverse recessed housing of said end (24; 124) of said locking piece (21; 121) is formed by a system (11; 111) for anchoring said fulcrum member (**27*a*; 127*a***) of said toggle lever onto said ski.

14. Binding mechanism according to claim 13, wherein said fulcrum member (**27*a*; 127*a*) of said toggle lever constitutes a counter-slide surface for said locking piece (21; 121**).

15. Binding mechanism according to any one of claims 11 to 14, wherein said toggle joint system comprises a U-shaped wire spring (27; 127) comprising a transverse arm (**27*a*; 127*a*) constituting a fulcrum member of said toggle lever, and wherein said transverse arm (27*a*, 127*a*) effects the recessed housing, in a vertical direction, of one end (23; 123) of said locking piece (21; 121**).

16. Binding mechanism according to any of claims 12 to 14, wherein said fulcrum member (**27*a*) of said toggle lever is anchored directly (13) on an anchoring block (11**) unitary with said ski.

17. Binding mechanism according to claim 16, wherein the anchoring of said fulcrum member (**27*a*) is anchored in said anchoring block (11) by lowering a locking lever (25) of said mechanism by means of associated shoulders (29) provided on said locking lever (25**).

18. Binding mechanism according to claim 12, wherein said fulcrum member (**127*a*) of said toggle lever is anchored onto the ski by means of a part (140) forming a slide surface which guides said movable locking piece (12) on which said fulcrum member (127*a*) is anchored, said part (140) being itself adapted to be anchored (112) on an anchoring block (111**) unitary with said ski.

19. Binding mechanism according to claim 18, wherein a housing (3) is provided for said fulcrum member (**127*a*) on said anchoring block (111**).

20. Binding mechanism according to claim 18 or 19, wherein a lubricant or other substance is inserted between said locking piece (121) said part forming said slide surface (140).

21. Process for mounting a binding mechanism for attachment of a boot to a ski having an upper surface provided with recessed housing means, said binding mechanism comprising an assembly component, first and second longitudinal ends and a movable element, said process comprising the steps of (a) inserting said first longitudinal end (23; 123) of said assembly component into said recessed housing means on said upper surface of said ski;

(b) lowering said movable element of said binding mechanism over said second longitudinal end of said binding mechanism; and (c) anchoring said movable element onto said ski in its lowered position.

22. Process according to claim 21, wherein said assembly component is a sliding locking piece (21; 121), said recessed housing means is arranged at each end (23, 24; 123, 124) of said locking piece (21; 121), and wherein said housing means, in relation to said ski, is arranged vertically and transversely only.

* * * * *